US006632350B2

(12) United States Patent
Gupta

(10) Patent No.: US 6,632,350 B2
(45) **Date of Patent: *Oct. 14, 2003**

(54) TWO STAGE HYDROPROCESSING AND STRIPPING IN A SINGLE REACTION VESSEL

(75) Inventor: Ramesh Gupta, Berkeley Heights, NJ (US)

(73) Assignee: ExxonMobile Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/960,014

(22) Filed: Sep. 21, 2001

(65) Prior Publication Data

US 2002/0074264 A1 Jun. 20, 2002

Related U.S. Application Data

(60) Provisional application No. 60/239,140, filed on Oct. 10, 2000.

(51) Int. Cl.[7] ..... C10G 65/02; C10G 65/04

(52) U.S. Cl. ..... 208/59; 208/58; 208/89; 208/210

(58) Field of Search ..... 208/58, 59, 210

(56) References Cited

U.S. PATENT DOCUMENTS

| | | | | |
|---|---|---|---|---|
| 5,705,052 A | * | 1/1998 | Gupta | 208/57 |
| 5,720,872 A | * | 2/1998 | Gupta | 208/57 |
| 5,928,497 A | | 7/1999 | Iaccino | 208/212 |
| 6,017,443 A | | 1/2000 | Buchanan | 208/210 |
| 6,264,828 B1 | * | 7/2001 | Baker et al. | 208/100 |

* cited by examiner

*Primary Examiner*—Nadine G. Norton
(74) *Attorney, Agent, or Firm*—Gerard J. Hughes; Jeremy J. Kliebert

(57) ABSTRACT

A hydrocarbonaceous feed is hydroprocessed in a single vessel containing two reaction stages and a stripping stage. The feed is fed into the first reaction stage to produce a vapor and liquid effluent which are separated, and the liquid stripped. The stripped liquid is passed as feed into the second stage, in which it meets with fresh hydrogen to produce a hydroprocessed liquid product and a hydrogen-rich vapor. The vapor is passed into the first stage, to provide the hydrogen for that stage. The use of a single vessel provides an efficient and economical addition to, or replacement for, a vessel for an existing hydroprocessing facility.

20 Claims, 1 Drawing Sheet

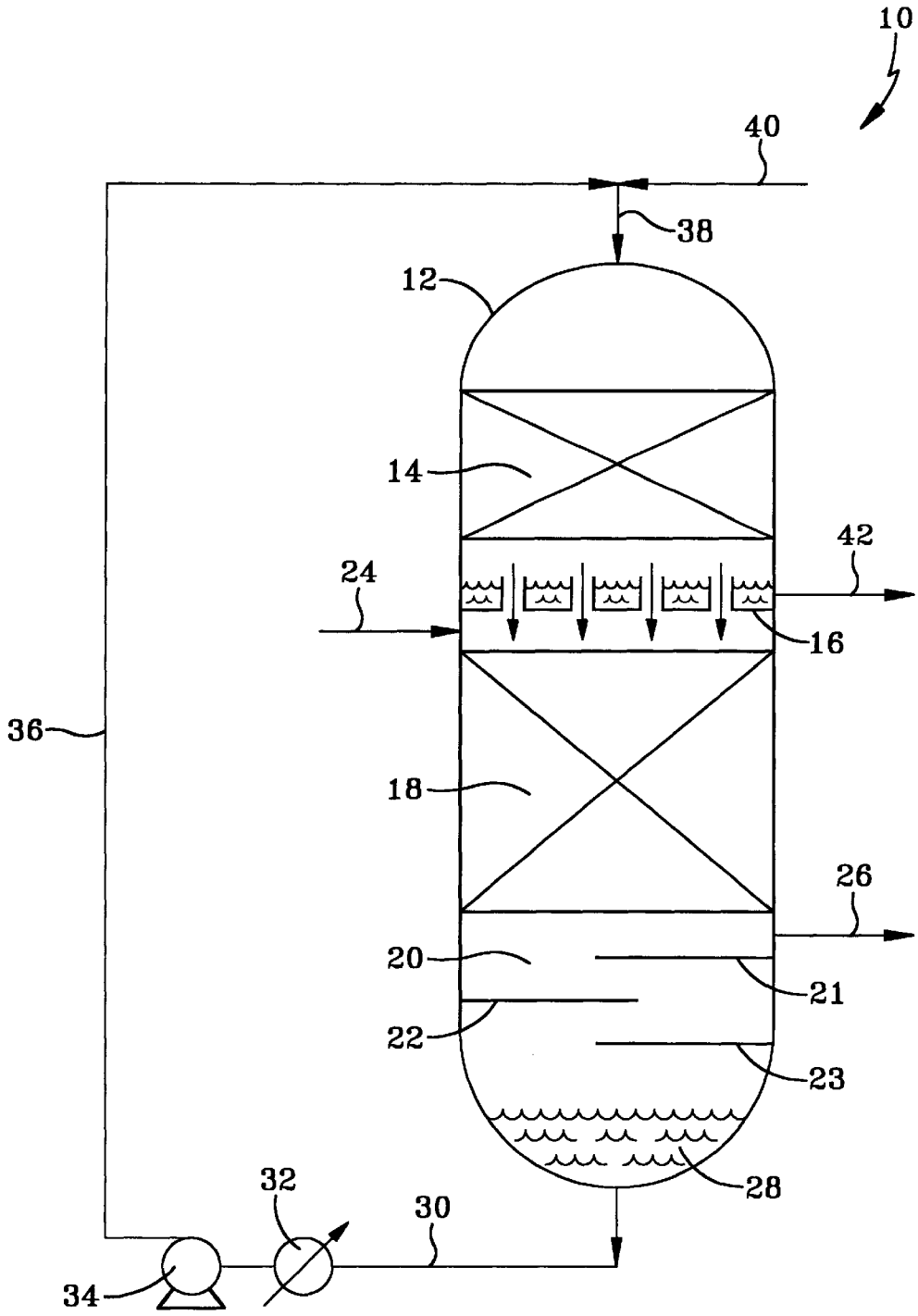
10
40
38
12
14
42
24
16
36
18
26
20
21
22
23
28
32
30
34

TWO STAGE HYDROPROCESSING AND STRIPPING IN A SINGLE REACTION VESSEL

CROSS REFERENCE TO RELATED APPLICATION

This case claims benefit of U.S. Provisional Patent Application No. 60/239,140 filed Oct. 10, 2000.

BACKGROUND OF THE INVENTION

1. Field of the Invention

The invention relates to catalytically hydroprocessing hydrocarbonaceous feeds using two reaction stages and a stripping stage in a single reaction vessel. More particularly the invention relates to catalytically hydroprocessing a hydrocarbonaceous feed with once-through hydrogen in two, cocurrent catalytic reaction stages. The first reaction stage produces a partially hydroprocessed liquid effluent which is stripped in a stripping stage and then passed into the second reaction stage. The stripped liquid effluent reacts with fresh hydrogen in the second stage to produce a hydroprocessed liquid. The stripping stage and both reaction stages are in the same reaction vessel.

2. Background of the Invention

Hydroprocessing involves removing at least a portion of a feed's heteroatom compounds, changing the molecular structure of the feed, and combinations thereof, by reacting the feed with hydrogen in the presence of a suitable hydroprocessing catalyst. Hydroprocessing includes processes such as hydrogenation, hydrocracking, hydrotreating, hydroisomerization and hydrodewaxing, and therefore plays an important role in upgrading petroleum streams to meet increasingly stringent quality specifications. For example, there is an increasing demand for improved heteroatom removal, particularly sulfur and nitrogen, improved aromatic compound saturation, and an overall boiling point reduction for some hydrocarbon fractions. Conventional hydroprocessing configurations have been developed which employ multiple vessels with both hydroprocessing and stripping stages. Some of the more recent configurations are disclosed, for example, in U.S. Pat. Nos. 5,705,052; 5,720,872; 5,968,346 and 5,985,135.

Environmental regulations have led to increasingly stringent hydrocarbon product specifications. Consequently, feeds and product streams require more upgrading in order to meet tighter specifications.

As the availability of lighter and cleaner feeds continues to decrease, hydroprocessing feeds may include more relatively high boiling feeds derived from such materials as coal, tar sands, shale oil, and heavy crudes, all of which typically contain significantly more undesirable components, such as halides, metals, unsaturates, and heteroatoms such as sulfur, nitrogen, and oxygen. There is therefore a need to further reduce the levels of undesirable components in hydroprocessing products, while employing feeds that increasingly contain significant amounts of undesirable species. It is not always possible or economically viable to construct a new, grass roots hydroprocessing facility within an existing refinery and, furthermore, most existing facilities have space constraints which limit or prevent adding additional reaction vessels, strippers, and associated utilities, to increase the extent of product hydroprocessing, hydroprocessing capacity, or both. There is therefore a need for cost-effective methods for increasing the hydroprocessing capacity of an existing hydroprocessing facility, increasing the purity of the hydroprocessed product, or both, without having to add multiple hydroprocessing reaction vessels and strippers.

SUMMARY OF THE INVENTION

In one embodiment, the invention is a hydroprocessing process comprising:

(a) reacting a hydrocarbonaceous feed with hydrogen in a first hydroprocessing reaction stage, in the presence of a first catalytically effective amount of a hydroprocessing catalyst, under first catalytic conversion conditions, to form a first stage effluent comprising a hydroprocessed hydrocarbonaceous liquid and a vapor;

(b) separating said first stage liquid and vapor effluents;

(c) stripping said first stage liquid effluent with a stripping gas in a stripping stage to produce at least a stripped liquid and a stripping vapor;

(d) combining said first stage vapor effluent and said stripping vapor and removing them from said vessel;

(e) passing said stripped liquid and fresh hydrogen or a fresh hydrogen treat gas into said second liquid stage in which they react in the presence of a second catalytically effective amount of a second hydroprocessing catalyst under second catalytic conversion conditions, to produce a second stage effluent comprising a hydroprocessed liquid product and a vapor which contains unreacted hydrogen, the first hydroprocessing stage, second hydroprocessing stage, and stripping stage being in a common vessel;

(f) passing said second stage vapor effluent into said first stage; and (g) removing said hydroprocessed liquid product from said vessel.

In another embodiment, the invention is a method for upgrading an existing hydroprocessing facility for hydroprocessing a hydrocarbonaceous feed, this hydroprocessing facility comprising one or more reaction vessels, strippers and associated equipment, to produce a hydroprocessed hydrocarbonaceous liquid, comprising the steps of:

(a) passing hydrogen and a hydrocarbonaceous feed which has been at least partially hydroprocessed by said existing facility into a first reaction stage in which they react in the presence of a catalytically effective amount of a first hydroprocessing catalyst under first catalytic conversion conditions, to produce a first stage effluent comprising (i) a further hydroprocessed liquid, and (ii) a vapor;

(b) separating said first stage liquid and vapor effluents;

(c) stripping said first stage liquid effluent in a stripping stage to remove strippable dissolved compounds produced by said first stage reaction to produce at least a stripped liquid and a stripping vapor;

(d) combining said first stage vapor effluent and said stripping vapor;

(e) passing said stripped liquid and fresh hydrogen or a fresh hydrogen treat gas into a second reaction stage, in which they react in the presence of a catalytically effective amount of a second hydroprocessing catalyst under second catalytic conversion conditions to produce a second stage effluent comprising a hydroprocessed hydrocarbonaceous liquid product and a vapor which contains unreacted hydrogen, the first reaction stage, second reaction stage, and stripping stage being in a common upgrading vessel;

(f) separating said second stage liquid and vapor effluents and recovering said liquid as hydroprocessed hydrocarbonaceous liquid product and passing said second stage vapor effluent into said first stage;

(g) recovering said hydroprocessed liquid product and wherein said upgrading vessel has been added to, or has replaced a vessel in, said existing hydroprocessing facility; and (h) conducting said combined first stage vapor effluent and said stripping vapor away from said upgrading vessel.

BRIEF DESCRIPTION OF THE DRAWING

The FIGURE schematically illustrates a flow diagram of an embodiment a hydroprocessing process of the invention, in which two reaction stages and a stripping stage are in the same vessel.

DETAILED DESCRIPTION

The invention is based on the discovery of an effective two stage hydroprocessing process with interstage stripping, in a single reaction vessel, in which a hydrocarbonaceous feed is reacted with hydrogen in the presence of a hydroprocessing catalyst in two separate reaction stages, each of which produces a vapor and liquid effluent. The vapor and liquid effluents are separated, and the first stage liquid effluent is stripped and passed as the feed into the second reaction stage, where it reacts with fresh hydrogen or a fresh hydrogen treat gas, to produce a hydroprocessed product liquid. The second reaction stage vapor effluent contains unreacted hydrogen and is passed into the first reaction stage to provide at least a portion of the hydrogen required for the first stage hydroprocessing. If the second stage vapor effluent contains all of the hydrogen required for the first stage reaction, then the amount of fresh hydrogen or fresh hydrogen treat gas passed into the second stage must be sufficient to provide the reaction hydrogen for both reaction stages.

In one embodiment, it is preferred that the first stage liquid effluent be stripped and that the stripped liquid contact fresh hydrogen in the second stage. While not wishing to be bound by any theory or model, it is believed that such an arrangement results in improved selectivity and second stage efficacy. This combination of stripping and contact with fresh hydrogen is particularly important for processes where undesirable impurities are formed during the first stage reaction and where the second stage catalyst, reaction, or both, may be adversely effected by the presence of the impurities. Heteroatom compounds (e.g., $H_2S$ and $NH_3$) are an illustrative, but nonlimiting example, of undesirable impurities that can be formed during the first stage reaction and which may be stripped out of the first stage liquid effluent before it is sent to the second reaction stage. Each reaction stage may employ cocurrent downflow of the feed and hydrogen reactants. In one embodiment, the hydroprocessing may occur in a single vessel, occupying minimal space. In another embodiment, an existing hydroprocessing unit comprising one or more reaction vessels, strippers and associated equipment may be upgraded with the addition or replacement of a single vessel to produce an improved hydroprocessed product. The improved product may have, for example, higher yield, purity, or both. The feed used in the process of the invention may be a partially hydroprocessed feed or one that has not been hydroprocessed.

The two reaction stages in the single vessel of the invention may contain the same or different catalysts and may be operated at substantially the same pressure. In the case of adding to or replacing a vessel in an existing hydroprocessing unit, the pressure in the single or "common" vessel of the invention may be higher or lower than that used in the existing unit, thereby providing additional operating flexibility. If desired, interstage quenching or indirect heat exchange may be employed in either or both reaction stages to control the reaction temperatures, increase the product liquid yield, or both, depending on the reaction temperature and feed for each of the two stages. It is preferred that the first reaction stage be located in the vessel below the second reaction stage and above the stripping stage.

In one embodiment the invention comprises a hydroprocessing process which includes two reaction stages and a stripping stage in the same vessel and which comprises the steps of:

(a) reacting a hydrocarbonaceous feed with hydrogen in a first hydroprocessing reaction stage, in the presence of a hydroprocessing catalyst, to form a first stage effluent comprising a hydroprocessed hydrocarbonaceous liquid and a vapor;

(b) separating the first stage liquid and vapor effluents;

(c) stripping the first stage liquid effluent with a stripping gas in a stripping stage to produce a stripped liquid and a vapor;

(d) combining the first stage vapor effluent and the stripping vapor and removing them from the vessel;

(e) passing the stripped liquid and fresh hydrogen or a fresh hydrogen treat gas into the second reaction stage in which they react in the presence of a hydroprocessing catalyst, to produce an effluent comprising a hydroprocessed liquid product and a vapor which contains unreacted hydrogen;

(f) passing the second stage vapor effluent into the first stage; and (g) removing the hydroprocessed liquid product from the reactor.

The second stage vapor effluent will preferably supply at least a portion of the first stage reaction hydrogen. Further embodiments include the second reaction stage located proximate the top of the vessel, with the first reaction stage located in the vessel below the second reaction stage, and the stripping stage located below the first reaction stage. Still further embodiments include the presence of at least one of indirect heat exchange cooling and quenching in either or both reaction stages, if desired, for temperature control and liquid yield maximization. A still further embodiment includes adding all of the reaction hydrogen as fresh hydrogen into the second stage. In this embodiment, the hydrogen-rich second stage vapor effluent will contain all the hydrogen required for the first reaction stage. In an embodiment in which the feed to be hydroprocessed contains impurities, such as sulfur and nitrogen heteroatom compounds, the first stage hydroprocessing will form $H_2S$ and $NH_3$, some of which are dissolved in the first stage hydroprocessed liquid. Stripping the first stage liquid effluent removes these dissolved species from the liquid and the substantially heteroatom-reduced liquid is fed into the second stage. The second stage catalyst for the aromatics saturation, paraffin isomerization or hydrocracking, etc., may also be one that is adversely effected by, or sensitive to the impurities or other compounds that have been stripped out of the first stage liquid effluent. For example, the second stage catalyst may then comprise a sulfur-sensitive noble metal catalyst for saturation, hydroisomerization, polymerization, etc. Alternately, the second stage catalyst could be the same as used in the first stage or a mixture of two different types of catalysts.

In the embodiment in which the invention comprises a method for upgrading an existing hydroprocessing system or facility having one or more reaction vessels, strippers and associated equipment and produces a hydroprocessed hydrocarbonaceous liquid for use as a feed for the upgrading, the method comprises:

(a) passing the hydroprocessed feed and hydrogen into a first reaction stage in which they react in the presence of a hydroprocessing catalyst, to produce a first stage effluent comprising (i) a further hydroprocessed liquid and (ii) a vapor;

(b) separating the first stage liquid and vapor effluents;

(c) stripping the first stage liquid effluent in a stripping stage to remove strippable dissolved compounds produced by the first stage reaction;

(d) combining the first stage vapor effluent and the stripping vapor and removing them from the vessel;

(e) passing the stripped liquid and fresh hydrogen or a fresh hydrogen treat gas into a second reaction stage, in which they react in the presence of a hydroprocessing catalyst to produce a second stage effluent comprising a hydroprocessed liquid product and a vapor which contains unreacted hydrogen;

(e) separating the second stage liquid and vapor effluents and recovering the liquid as hydroprocessed hydrocarbonaceous liquid product and passing the second stage vapor effluent into the first stage; and (f) recovering the hydroprocessed liquid product, wherein the two reaction stages and the stripping stage are all in the same vessel, and wherein the vessel has been added to, or has replaced a vessel in, an existing hydroprocessing facility.

By upgrading an existing hydroprocessing system or facility is meant (i) producing a purer product, (ii) increasing the amount of product that can be produced by the facility, or both. The further embodiments referred to above also apply to this embodiment for upgrading an existing hydroprocessing facility.

The feed for the present process comprises a hydrocarbonaceous liquid and preferably a hydrocarbon liquid, such as a synthetic crude or a distillate fuels or lubricant fraction, that may or may not have been partially hydroprocessed. A partially hydroprocessed feed is one which has already been at least partially catalytically refined and purified by any of many known hydroprocessing processes. In the case of hydrotreating, a portion of the heteroatom compounds will already have been removed, and some of the aromatic compounds may or may not have been removed by saturation. For desulfurization, the sulfur content of the feed for the process of the invention will typically have less than 500 wppm sulfur, in the form of various sulfur bearing compounds and preferably less than 400 wppm of sulfur. The nitrogen content of the feed will range from about 20 to 1000 wppm, respectively and preferably no more than 300 wppm. By way of an illustrative, but nonlimiting example, the respective sulfur, nitrogen, and oxygen contents of a diesel stock purified according to the process of the invention will typically range from about 30–100 wppm and 20–100 wppm, respectively, depending on the impurity level in the feed. The stripping and reaction stages in the vessel in the practice of the present invention are operated at substantially the same pressure, which may be less than 600 psia or greater than than 850 or 1000 psia, depending on the desired reaction and the catalyst used. The reaction temperature in the first and second reaction stages may be the same or different, with the actual values depending on the feed, reactions and catalysts. A simple chimney and tray type of gas-liquid separation means, or equivalent, is located between these two reaction stages, with the separated, second reaction stage gaseous effluent passing from the separation means directly down into the top of the first reaction stage below, without the need for a gas compressor. The separated second stage liquid effluent comprises the hydroprocessed product liquid. The hydrocarbonaceous feed is introduced into the top of the first reaction stage, in which it reacts with fresh hydrogen or a fresh hydrogen treat gas, in the presence of a hydroprocessing catalyst. All of these features are preferred in the practice of the invention and permit the use of a single and relatively small and space efficient reaction vessel to be added to, or replace a vessel in, an existing hydroprocessing facility.

In the context of the invention, the terms "fresh hydrogen" and "hydrogen-containing treat gas" are synonymous, and refer to either pure hydrogen or a hydrogen-containing treat gas which is a treat gas stream containing hydrogen in an amount at least sufficient for the intended reaction, plus other gas or gasses (e.g., nitrogen and light hydrocarbons such as methane) which will not adversely interfere with or affect either the reactions or the products. The fresh hydrogen treat gas stream introduced into the second reaction stage will preferably contain at least about 50 vol. %, more preferably at least about 75 vol. % hydrogen. For many applications it is preferred that the hydrogen introduced into the second stage be sufficient to provide all of the reaction hydrogen for both the second and first reaction stages. However, in some cases a source of hydrogen sufficiently low in sulfur, nitrogen or any other species that may adversely effect the second stage reaction or catalyst may be available which, while not suitable for the second stage, may be useable in the first stage. In this case, all or a portion of this less pure hydrogen may be introduced into the first stage. This will reduce the amount of fresh hydrogen passed into the second stage.

By hydroprocessing is meant a process in which hydrogen reacts with a hydrocarbonaceous feed to remove one or more heteroatom impurities such as sulfur, nitrogen, and oxygen, to change or convert the molecular structure of at least a portion of the feed, or both. Non-limiting examples of hydroprocessing processes which can be practiced by the present invention include forming lower boiling fractions by hydrocracking; hydrogenating aromatics and other unsaturates; hydrotreating to remove heteroatoms and optionally remove aromatics by saturation; hydroisomerization and catalytic dewaxing of waxes and waxy feeds; and demetallation of heavy streams. Ring-opening, particularly of naphthenic rings, can also be considered a hydroprocessing process. By hydrocarbonaceous feed is meant a primarily hydrocarbon material obtained or derived from, for example, crude petroleum oil, from tar sands, from coal liquefaction, shale oil and hydrocarbon synthesis. The reaction stages used in the practice of the present invention are operated at effective temperatures and pressures for the desired reaction. For example, typical hydroprocessing temperatures will range from about 150° F. to about 950° F., at pressures from about 50 psig to about 3,000 psig, and more typically 50 to 2,500 psig. Feeds suitable for use in such systems include those ranging from the naphtha boiling range to heavy feeds, such as gas oils and resids. Non-limiting examples of such feeds which can be used in the practice of the present invention include vacuum resid, atmospheric resid, vacuum gas oil (VGO), atmospheric gas oil (AGO), heavy atmospheric gas oil (HAGO), steam cracked gas oil (SCGO), deasphalted oil (DAO), light cat cycle oil (LCCO), natural and synthetic feeds derived from tar sands, shale oil, coal liquefaction and hydrocarbons synthesized from a mixture of $H_2$ and CO via a Fischer-Tropsch type of hydrocarbon synthesis.

The invention can be further understood with reference to the FIGURE, which is a schematic drawing of a hydroprocessing unit useful in the practice of the invention. In this particular illustrative embodiment the hydroprocessing process is a hydrotreating process and the reaction stages hydrotreating stages. For the sake of simplicity, not all process reaction vessel internals, valves, pumps, heat transfer devices, etc., are shown. Thus, a hydrotreating unit 10, for hydrotreating a feed comprising a distillate fraction, such as a diesel or lube oil fraction, which may or may not have been partially hydrotreated, comprises a single reaction vessel 12 containing two cocurrent downflow reaction stages, with a vapor-liquid separating means between these two stages and a stripping stage located below the first reaction stage. The bottom interior portion of the vessel is used for vapor-liquid separation and collection of the first reaction stage liquid effluent. For the sake of simplicity, not all process reaction vessel internals, valves, pumps, heat transfer devices etc. are shown. Thus, a hydrotreating unit 10 for purifying a diesel fraction comprises a single, hollow, cylindrical metal reactor vessel 12, containing within respective first and second reaction stages defined by fixed catalyst beds 18 and 14, separated by a simple chimney type of gas-liquid separation tray 16 within. Catalyst beds 14 and 18 respectively comprise respective aromatics saturation and heteroatom removal reaction stages. Alternately, both stages may comprise a heteroatom removal catalyst, if the objective of the process is primarily sulfur removal, as opposed to, for example, both sulfur removal and aromatics saturation. A vapor-liquid contacting stage 20 comprises the stripping stage and is shown disposed below the first reaction stage 18, in which heteroatom compounds are removed from the diesel fraction feed. Stripping stage 20 is schematically indicated by three stripping trays 21, 22 and 23, although packing may be used in place of trays, as is known. The heteroatom and aromatics-containing diesel fraction feed enters the first reaction stage 12, via feed line 24. The hydrogen-rich vapor effluent from the second reaction stage is separated from the resulting purified diesel fraction by gas permeable gas-liquid separation means 16, such as the aforementioned chimney-type separation tray. The hydrogen-rich vapor effluent from the second reaction stage then passes down through the gas permeable tray 16 separating the first and second reaction stages. Such trays are conventional and typically comprise a metal disk provided with a plurality of pipes or chimneys extending therethrough, a bubble cap tray and the like. The hydrogen-rich vapor from the second reaction stage passes down into catalyst bed 18, in which the unreacted hydrogen in the vapor effluent reacts with the downflowing diesel fraction to remove heteroatom compounds. This produces an effluent comprising a liquid diesel fraction of reduced heteroatom content, along with a vapor which contains $H_2S$, $NH_3$ possibly $H_2O$ vapor, any diluent (e.g., methane and the like) that may have been present in the hydrogen treat gas, and any usually minor amounts of gaseous hydrocarbons produced by the reaction. The first stage liquid effluent then passes down into stripping stage 20, in which it contacts an upflowing stripping gas, which may be hydrogen, steam, methane and the like, which strips, out of the downflowing liquid, dissolved heteratom species, such as $H_2S$ and $NH_3$, formed by the reaction in the first stage. The upflowing stripping gas mixes with the first reaction stage gaseous effluent, with the mixture then passing out of the reactor vessel via line 26. This gas mixture may be further processed downstream to remove the sulfur and nitrogen for disposal. The stripped first reaction stage liquid effluent 28, collects in the hollow bottom of the reactor vessel, as shown. This liquid is withdrawn from the bottom of the vessel via line 30, passes through an indirect heat exchanger 32, if required, and then to liquid pump 34 which passes it up, via lines 36 and 38, into the top of the vessel 12, and down into the second reaction stage 14 below. Fresh hydrogen or hydrogen treat gas is introduced, via lines 40 and 38, into the top of vessel 12 over the second reaction stage 14. The hydrogen is present in an amount sufficient to supply the reaction hydrogen needed for both reaction stages. The hydrogen mixes with the heteroatom-reduced diesel fraction and reacts with aromatics in it in the presence of the noble metal catalyst, to remove aromatics by saturation. This produces a second reaction stage liquid effluent comprising the further purified diesel fraction, now a diesel stock product, which now has a heteroatom and aromatics content less than that in the fraction introduced into the reactor via line 24. It also produces a hydrogen-rich second stage vapor effluent which, after being separated from the liquid via means 16, is passed down into the second reaction stage. The purified diesel stock is removed from the reactor via line 42 and sent to storage, used for blending or combined with an appropriate additive package to form a completed fuel. Operating the vessel at a relatively high pressure enables the use of a more active (e.g., noble metal) catalyst for reactions such as, for example, aromatics saturation, as compared to a less active (e.g., nickel) catalyst, which would require a substantially greater amount of catalyst and concomitantly larger vessel. The aromatics saturation catalyst reaction stage, or second reaction stage, is preferably located in the upper portion of the vessel, above the first reaction stage, to produce a product liquid having a very low level of sulfur or a mixture of a heteroatom and aromatics removal catalysts. However, in this illustration it is preferred that the second stage catalyst comprise one that is selective for aromatics removal and not heteroatom removal, to produce a product liquid having a very low level of sulfur, or a mixture of a heteroatom and aromatics removal catalysts.

The term "hydrotreating" as used herein refers to a process wherein a feed to be hydrotreated and a hydrogen-containing treat gas react in the presence of at least one or more catalysts primarily active for the removal of at least heteroatoms, such as sulfur, and nitrogen, and, optionally, also for the saturation of aromatics. Suitable hydrotreating catalysts for use in a hydrotreating embodiment of the invention include any conventional hydrotreating catalyst. Examples include catalysts comprising of at least one Group VIII metal catalytic component, preferably Fe, Co and Ni, more preferably Co and/or Ni, and most preferably Co; and at least one Group VI metal catalytic component, preferably Mo and W, more preferably Mo, on a high surface area support material, such as alumina. Other suitable hydrotreating catalysts include zeolitic catalysts, as well as noble metal catalysts where the noble metal is selected from Pd and Pt. As mentioned above, it is within the scope of the present invention that more than one type of hydrotreating catalyst may be used in the same reaction stage or zone. Typical hydrotreating temperatures range from about 350–850° F., with 600–700° F. being typical and with pressures from about 50 psig to about 3,000 psig, preferably from about 50 psig to about 2,500 psig. If one of the reaction stages is a hydrocracking stage, the catalyst can be any suitable conventional hydrocracking catalyst run at typical hydrocracking conditions. Typical hydrocracking catalysts are described in U.S. Pat. No. 4,921,595 to UOP, which is incorporated herein by reference. Such catalysts are typically comprised of a Group VIII metal hydrogenating component on a zeolite cracking base. Hydrocracking conditions include temperatures from about 200° to 425° C.; a pressure of about 200 psig to about 3,000 psig; and liquid hourly space velocity from about 0.5 to 10 V/V/Hr, preferably from about 1 to 5 V/V/Hr. Non-limiting examples of aromatics saturation or hydrogenation catalysts include nickel, cobalt-molybdenum, nickel-molybdenum, and nickel-tungsten. Noble metal (e.g., platinum and/or palladium) containing catalysts can also be used and when used at high pressure are more selective for aromatics removal. The aromatics saturation zone is preferably operated at a temperature from about 350° F. to about 850° F., more preferably from about 450° F. to about 700° F., at a pressure from about 100 psig to about 3,000 psig, preferably from about 200 psig to about 1,200 psig, and at a liquid hourly space velocity (LHSV) of from about 0.3 V/V/Hr. to about 2 V/V/Hr.

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A hydroprocessing process comprising:

a) reacting a hydrocarbonaceous feed with hydrogen in a first hydroprocessing reaction stage in the presence of a first catalytically effective amount of a hydroprocessing catalyst, under first catalytic conversion conditions, to form a first stage effluent comprising a hydroprocessed hydrocarbonaceous liquid and a vapor;

b) passing said first stage effluent to a stripping stage wherein it is contacted with a stripping gas to form a stripped first stage liquid effluent and a vapor effluent comprised of the first reaction stage vapor and said stripping gas;

c) removing said vapor effluent;

d) passing said stripped liquid and hydrogen into a second reaction stage in which they react in the presence of a second catalytically effective amount of a second hydroprocessing catalyst under second catalytic conversion conditions, to produce a second stage effluent comprising a hydroprocessed liquid product and a vapor which contains unreacted hydrogen, the first hydroprocessing stage, second hydroprocessing stage, and stripping stage being in a common vessel;

e) passing said second stage vapor effluent into said first stage; and f) removing said hydroprocessed liquid product from said vessel.

2. A process according to claim 1 wherein said second stage vapor effluent supplies at least a portion of said hydrogen required for said first stage reaction.

3. A process according to claim 2 wherein said second stage is located above said first stage and said second stage vapor is passed directly from said second stage, down into said first stage.

4. A process according to claim 3 wherein said stripping stage is located below said first reaction stage.

5. A process according to claim 4 wherein said hydrocarbonaceous feed comprises a hydrocarbon.

6. A process according to claim 5 wherein said first stage liquid effluent contains strippable species that adversely effect said second stage catalyst or reaction.

7. A process according to claim 6 wherein said feed comprises a hydrocarbon distillate.

8. A process according to claim 7 wherein said second stage vapor effluent supplies all of the hydrogen for said first stage.

9. A process according to claim 8 wherein said second stage comprises a catalyst different from said first stage catalyst.

10. A method for upgrading an existing hydroprocessing facility for hydroprocessing a hydrocarbonaceous feed, this hydroprocessing facility comprising one or more reaction vessels, strippers and associated equipment, to produce a hydroprocessed hydrocarbonaceous liquid, comprising the steps of:

a) passing hydrogen and a hydrocarbonaceous feed which has been at least partially hydroprocessed by said existing facility into a first reaction in which they react in the presence of a catalytically effective amount of a first hydroprocessing catalyst under first catalytic conversion conditions, to produce a first stage effluent comprising (i) a further hydroprocessed liquid, and (ii) a vapor;

b) passing said first stage effluent to a stripping stage wherein it is contacted with a stripping gas to form a stripped first stage liquid effluent and a vapor effluent comprised of the first reaction stage vapor and said stripping gas;

c) removing said vapor effluent;

d) passing said stripped liquid and fresh hydrogen into a second reaction stage, in which they react in the presence of a catalytically effective amount of a second hydroprocessing catalyst under second catalytic conversion conditions to produce a second stage effluent comprising a hydroprocessed hydrocarbonaceous liquid product and a vapor which contains unreacted hydrogen, the first reaction stage, second reaction stage, and stripping stage being in a common upgrading vessel;

e) separating said second stage liquid and vapor effluents and recovering said liquid as hydroprocessed hydrocarbonaceous liquid product and passing said second stage vapor effluent into said first stage;

f) recovering said hydroprocessed liquid product and wherein said upgrading common vessel has been added to, or has replaced a vessel in, said existing hydroprocessing facility; and g) conducting said combined first stage vapor effluent and said stripping vapor away from said common upgrading vessel.

11. A method according to claim 10 wherein said second stage vapor effluent supplies at least a portion of said hydrogen required for said first stage reaction.

12. A method according to claim 11 wherein said second stage is located above said first stage and said second stage vapor is passed directly from said second stage, down into said first stage.

13. A method according to claim 12 wherein said stripping stage is located below said first reaction stage.

14. A method according to claim 13 wherein said hydrocarbonaceous feed comprises a hydrocarbon.

15. A method according to claim 14 wherein said first stage liquid effluent contains strippable species that adversely effect said second stage catalyst or reaction.

16. A method according to claim 15 wherein said feed comprises a hydrocarbon distillate.

17. A method according to claim 16 wherein said second stage vapor effluent supplies all of the hydrogen for said first stage.

18. A method according to claim 17 wherein said second stage comprises a catalyst different from said first stage catalyst.

19. A method according to claim 18 wherein either or both reaction stages are cooled or quenched to increase liquid yield.

20. A method according to claim 10 wherein the amount of hydrocarbonaceous liquid product produced by said upgraded existing hydroprocessing facility is greater than that produced by said existing hydroprocessing facility.

* * * * *